United States Patent [19]

Maynard et al.

[11] Patent Number: 4,899,402

[45] Date of Patent: Feb. 13, 1990

[54] HANDICAP-ACCESSIBLE BATH FACILITY

[75] Inventors: John Maynard; Dale Sexton, both of Ashland, Ky.

[73] Assignee: A. C. Marble, Inc., Ashland, Ky.

[21] Appl. No.: 251,160

[22] Filed: Sep. 29, 1988

[51] Int. Cl.[4] ..... A47K 4/00

[52] U.S. Cl. ..... 4/663; 4/613; 4/604; 52/357

[58] Field of Search ..... 4/663, 604, 612, 613, 4/614, 599, 600, 596; 52/34, 35

[56] References Cited

U.S. PATENT DOCUMENTS

| | | | |
|---|---|---|---|
| D. 252,942 | 9/1974 | Fairchild | D23/283 |
| D. 255,829 | 7/1980 | Swenson | D23/283 |
| 1,766,125 | 6/1930 | Jahns . | |
| 2,712,164 | 7/1955 | Sheffield | 20/2 |
| 3,457,568 | 7/1969 | Amatruda | 4/146 |
| 3,707,165 | 12/1972 | Stahl | 52/34 |
| 3,765,036 | 10/1973 | Dykstra | 52/35 |
| 3,821,818 | 7/1974 | Alosi | 4/191 |
| 4,471,501 | 9/1984 | Heymann | 4/599 |
| 4,757,561 | 7/1988 | Crump | 4/604 |

FOREIGN PATENT DOCUMENTS

| | | | |
|---|---|---|---|
| 1294295 | 4/1969 | Fed. Rep. of Germany | 4/663 |
| 3440545 | 5/1986 | Fed. Rep. of Germany | 4/614 |

OTHER PUBLICATIONS

Special Care, 1983, (1 page-front & back), Aqua Glass Tub and Shower Units Model No. SC6060.

*Primary Examiner*—Henry J. Recla
*Assistant Examiner*—Edward C. Donovan
*Attorney, Agent, or Firm*—Griffin, Branigan & Butler

[57] ABSTRACT

A handicap-accessible bath facility (10), and a method of making the same, involves a two piece modular wall (22) having a height and a length which are less than the height and length of an existing room (16) in which the bath facility is to be mounted. The modular wall comprises top and bottom wall assemblies (42, 44) which are placed parallel to a first existing wall (14) and abutting a second existing wall (16) to form a shower compartment (124). A factory molded shower base (24) is placed on an existing floor (21) in the shower compartment and defines a shower-base ramp (94) at an entrance to the compartment. A barrier line (98) at the top of the ramp, between the ramp and a drain depression (90) formed in the shower base prevents water from flowing out of the shower compartment. Wall panels (26, 28, 30) line the shower compartment and engage a vertical lip (100) of the shower base for preventing water from leaving the shower compartment at intersections of these panels with the shower base. A vanity top (32), with right angled edges (106, 108) forms a brace between the modular wall and the second existing wall. A commode (36), sink (34), and light (40) are mounted on an outside surface of the modular wall.

14 Claims, 3 Drawing Sheets

HANDICAP-ACCESSIBLE BATH FACILITY

BACKGROUND OF THE INVENTION

This invention relates broadly to the art of bathroom facilities, and more specifically to bathroom facilities which can be used by handicapped persons in wheelchairs, walkers, and lift units.

In recent years, emphasis has been placed on making public facilities accessible to handicapped persons, including persons in wheelchairs. However, most homes, hotel rooms, apartments, and the like are constructed for non-handicapped people, for both cost-cutting and aesthetic reasons, unless such buildings are specifically constructed with handicapped persons in mind. Normally, even when homes are constructed with handicapped persons in mind, tubs and showers thereof are merely provided with grab bars, which is totally inadequate for many situations. It often occurs, however, that a person unexpectedly becomes seriously handicapped while living in a house or apartment which was not constructed, or inadequately constructed to accommodate seriously handicapped persons. This happens, for example, when a person sustains a debilitating injury, becomes old, is struck with illness, or the like. When this occurs, it is often quite difficult and expensive to radically modify a home to include bathroom facilities for accommodating the newly handicapped person. Thus, it is an object of this invention to provide a handicap-accessible bath facility which can be relatively inexpensively and easily constructed in an existing house or other building to accommodate seriously handicapped persons.

Along these lines, even when existing bathrooms can be enlarged to accommodate wheelchairs, handicapped persons in many such houses still find it difficult to get from their bedrooms to the bathrooms unless the houses themselves are further modified, thereby further increasing the expense of modifying a house to accommodate a handicapped person. Therefore, it is another object of this invention to provide a handicap-accessible bath facility and method of installing the same which does not require extensive modifications of existing homes, but rather, can be installed in existing bedrooms or other rooms of such homes.

Often, it is desirable to construct a handicap-accessible bath facility in a building on a temporary basis and remove it later. Such a need arises when a person is either terminally ill or temporarily ill, both of which happen fairly often. Thus, it is an object of this invention to provide a handicap-accessible bath facility which can be relatively easily and inexpensively installed when a person becomes handicapped but which can also be relatively easily and inexpensively removed when it is no longer necessary to have such a facility.

It is also an object of this invention to provide such a handicap-accessible bath facility which is durable and convenient for a handicapped person in a wheelchair to use, but yet which is relatively inexpensive and easy to install.

SUMMARY

According to principles of this invention, a handicap-accessible bath facility includes a modular wall having a length shorter than that of an existing room wall and a height shorter than that of the height of an existing room ceiling. The modular wall is mountable on an existing room floor parallel to a first existing room wall with a first end edge against a second existing room wall and a vanity top serving as a brace between a non-shower side of the modular wall and the second existing room wall. The facility also includes a single piece molded shower base to be placed on the existing room floor on a shower side of the modular wall between the modular wall and the first and second existing room wall which form a shower compartment. The top surface of the shower base defines a ramp at a ramp edge thereof, a drain depression in a central area thereof, and a water retainer barrier line at the top of the ramp between the ramp and the depression. A wheelchair can easily roll up the ramp and over the water retainer barrier line to the drain depression. The handicap-accessible bath facility also includes waterproof wall panels to be placed on the walls in the shower compartment, a sink in the vanity, and a commode on the non-shower side of the modular wall. Utility lines are mounted in the modular wall for servicing the commode, sink and a light mounted on the non-shower side of the modular wall and a shower mounted on the shower side of the modular wall. Lower end edges of the wall panels engage the shower base so as not to allow water to exit from the shower cavity between the wall panels and the shower base. In this regard, the shower base is molded of a single piece to define the drain depression, the ramp, and the water-retainer barrier line. An additional lip element extends vertically on three edges of the shower base so that the wall panels can be positioned inside the lip element to provide the waterproof engagement between the wall panels and the shower base.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
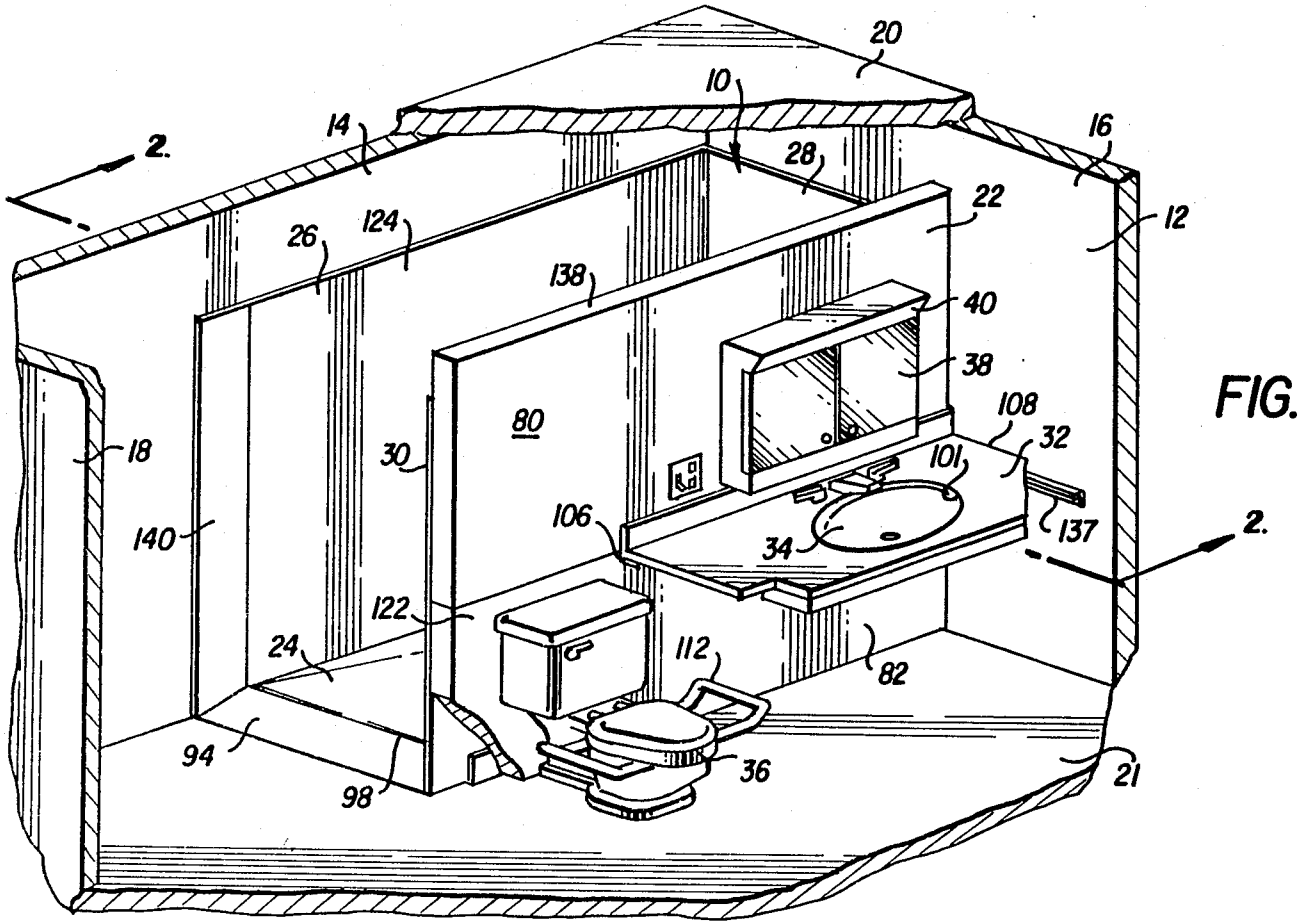
FIG. 1 is an isometric view of a handicap-accessible bath facility of this invention mounted in an existing room.

Referring now to FIG. 1, a handicap-accessible bath facility 10 is shown mounted in an existing room 12 having a first wall 14, a second wall 16, a third wall 18, a ceiling 20, and a floor 21.

Figure 5:
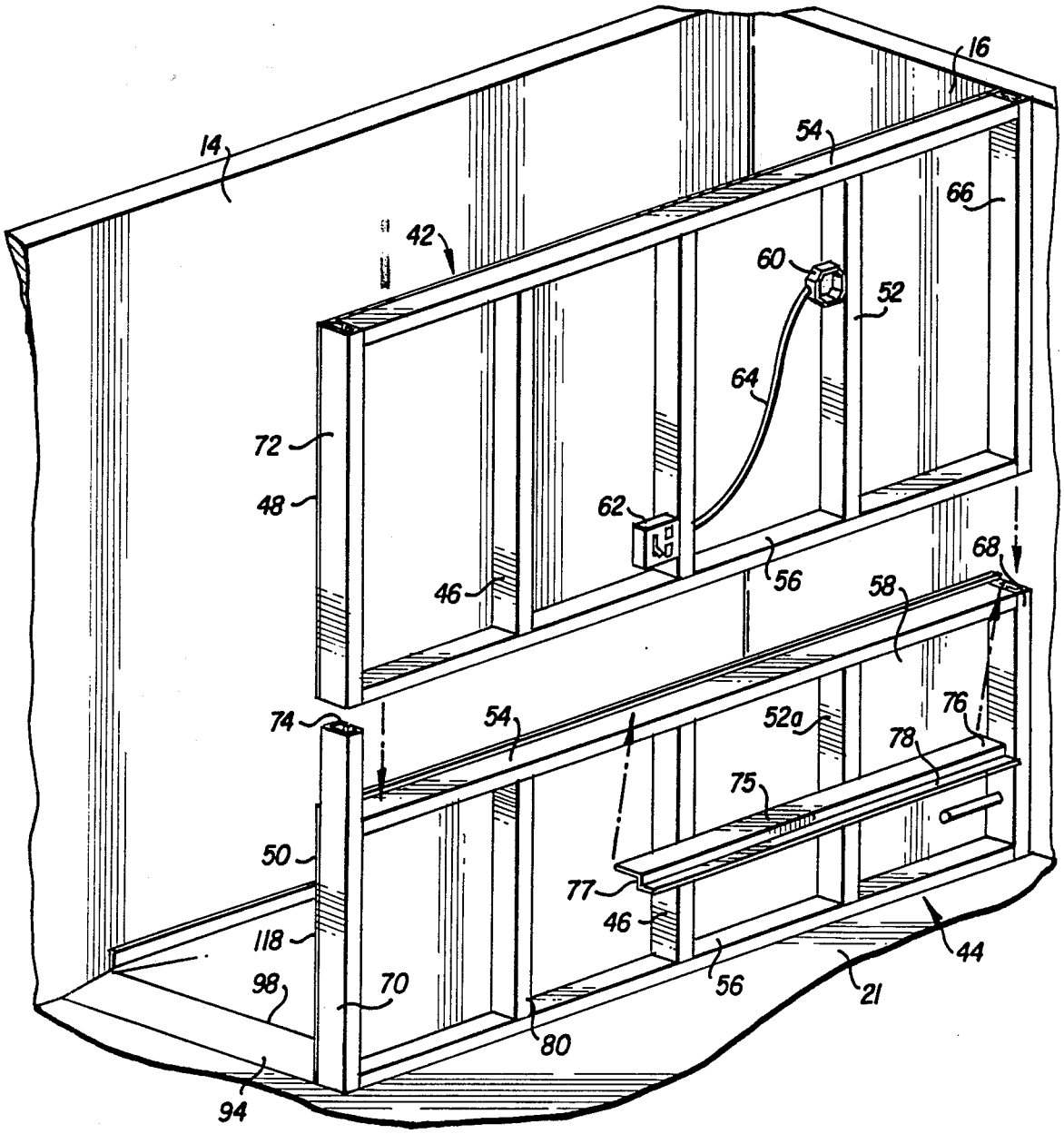
FIG. 5 is an isometric exploded view of elements of the modular wall of this invention shown during its assembly.

The handicap-accessible bath facility 10 includes a modular wall 22, a shower base 24, shower wall panels 26, 28, and 30, a vanity top 32 having a sink 34, a commode 36, and a mirrored wall cabinet 38 having a light 40. Looking first at the modular wall 22, with reference to FIG. 5, it is constructed of factory-built top and bottom wall assemblies 42 and 44. Both the top and bottom wall assemblies 42 and 44 are constructed of 0.025 gauge, 6 inch, steel frames 46 with sheets of waterproof, fire resistant sheet rock 48 and 50 on shower sides thereof. The 6 inch steel frames 46 each include vertical studs 52 (52A for the bottom wall assembly) a cap 54 and a base 56 so as to form hollow spaces 58 therebetween for accommodating utility lines, such as pipe and electrical wires. In this respect, a factory-installed light box 60 and switch and plug box 62 interconnected by a wire 64 in flexible conduit are mounted in the top wall assembly 42. Although first end vertical studs 66 and 68 of the top and bottom wall assemblies 42 and 44 are approximately the same height as their respective wall assemblies, a second end vertical stud 70 of the bottom wall assembly 44 is longer than the height of the bottom wall assembly 44. In this regard, the bottom assembly 44 has a height of 36 inches from the top of its cap 54 to the bottom of its base 56. However, the second end vertical stud 70 is 56 inches long. A second end vertical stud of the top wall assembly 42 is approximately the same length as the height of the top wall assembly 42, however, its cross sectional circumference is slightly larger so that it can receive a top end 74 of the second end vertical stud 70 in a hollow interior thereof for firmly mounting second ends of the top and bottom wall assemblies 42 and 44 together.

In this regard, when the top assembly base 56 is fastened to the bottom assembly cap 54, a top horizontal member 75 of a vanity support shelf 76 is mounted between them with a bottom horizontal member 78, coupled to the top horizontal member 75 by a vertical member 77, extending away from the modular wall 22 on a non-shower side 80 thereof.

In a preferred embodiment the bottom wall assembly 44 is 60 inches long and 36 inches high, not including the second end vertical stud 70, and the top wall assembly 44 is 60 inches long and 44 inches high.

Figure 2:
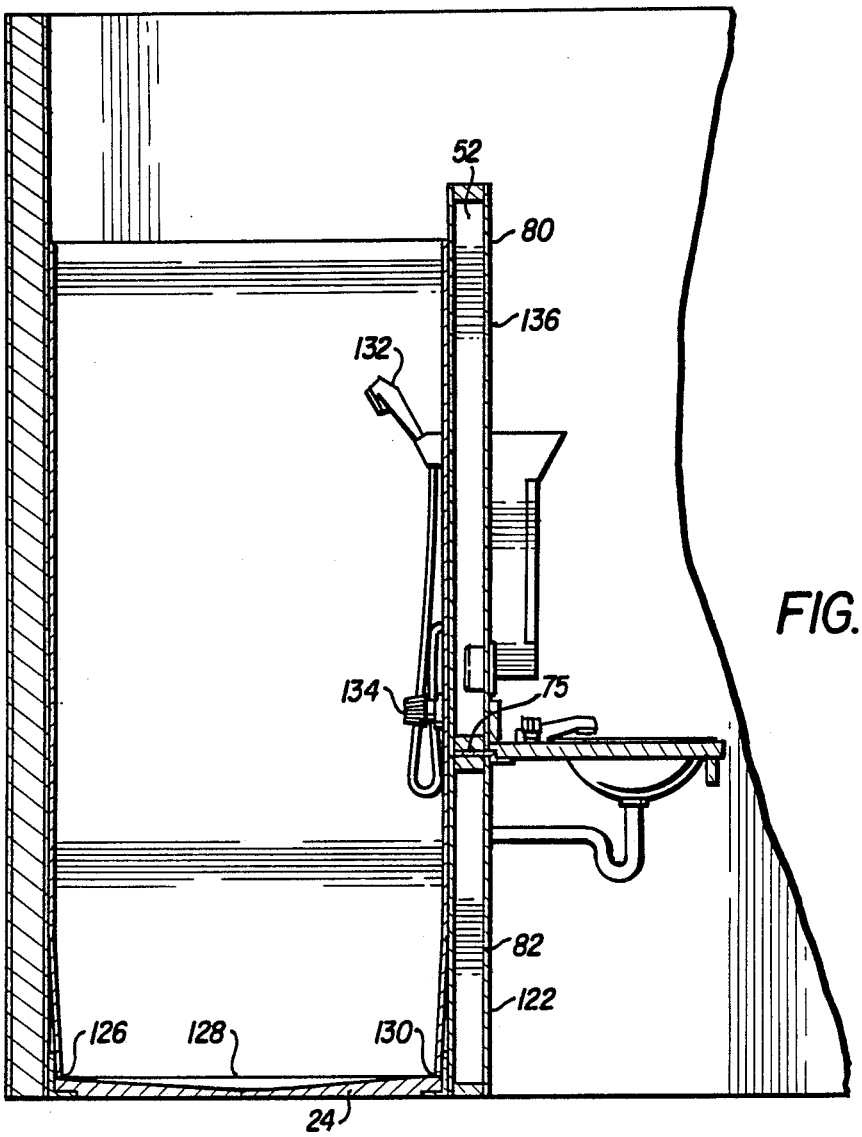
FIG. 2 is a cross sectional view taken on line 2—2 in FIG. 1.

When the modular wall 22 is completed, as shown in FIGS. 1 and 2, it includes a two-piece vinyl covering 82 glued on the non-shower side 80 thereof. Before this vinyl covering 82 is applied to the non-shower side of the steel frames 46, however, pipe and electrical connections either from the existing floor 21 or the second wall 16 of the existing room are placed in the hollow spaces 58 of the top and bottom wall assemblies 42 and 44. This will be described further below when the method of using this invention is set forth.

Figure 4:
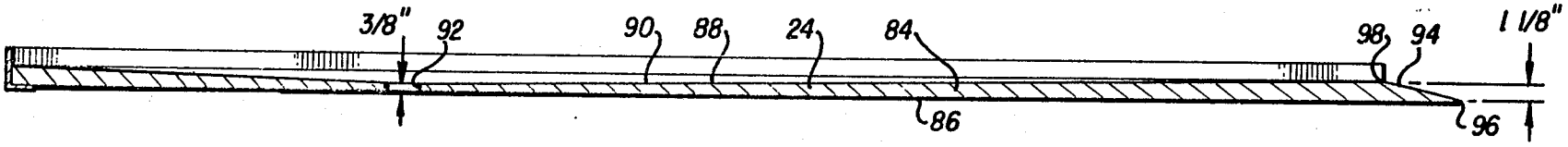
FIG. 4 is a cross sectional view of the shower base taken on line 4—4 in FIG. 3, with the various wall and wall panel sections being removed.
Figure 3:
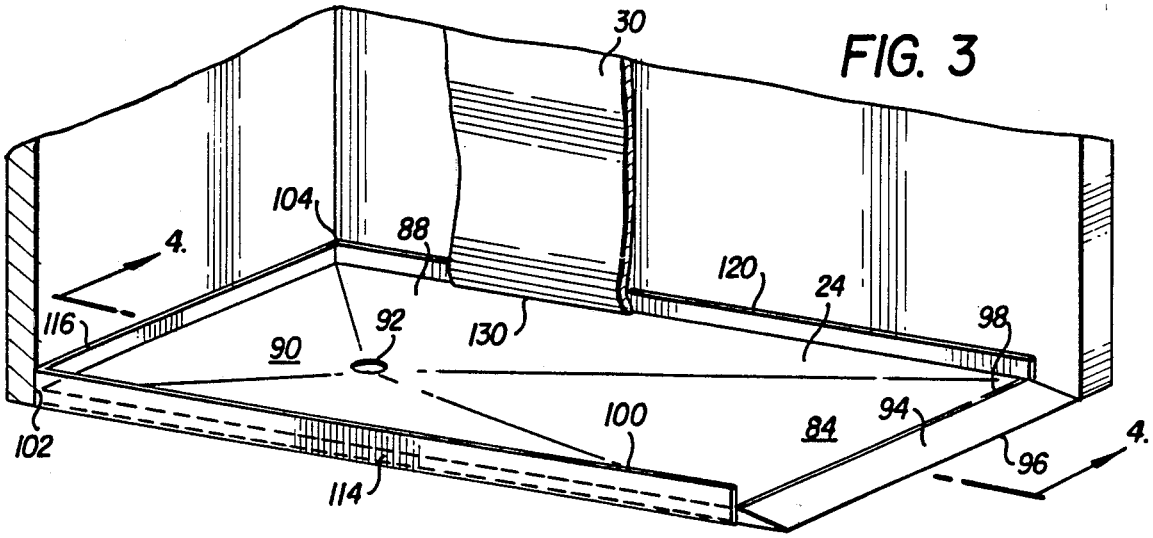
FIG. 3 is an isometric view of a shower base showing portions of a second existing wall, a modular wall, and a wall panel, of this invention, with other elements not being shown for purposes of illustration.

Looking now at the shower base 24 shown in detail in FIGS. 2, 3 and 4, a main member 84 thereof is cast as one piece of cultured marble to form a flat bottom surface 86, a top contoured surface 88 defining a drain depression 90 about a drain hole 92 through the main member 84, and a shower-base ramp 94 at a ramp edge 96. The top contoured surface 88 also defines a water retaining barrier line 98 of increased elevation at the top of the shower-base ramp 94, between the ramp 94 and the drain depression 90. In this respect, the drain depression 90 extends approximately to one side of the barrier line 98, as can be seen in FIG. 4, and the ramp 94 extends to the other side. In a preferred embodiment, this barrier line 98 is less than a $\frac{1}{2}$ inch thick, and is usually only about an $\frac{1}{4}$ of an inch thick so that the drain depression 90 can extend as close to the ramp 94 as is possible whereby the drain depression 90 is as large as possible. In this respect, any water falling on the drain depression 90 is channeled toward the drain hole 92. The top contoured surface 88 has a textured, non-skid feel. The main member 84 is non-porous and its surface is sufficiently strong to hold 4,000 pounds. This member is cast of about 78% marble dust and 22% polyester resin gel cote and fillers. In a preferred embodiment, an outside rectangular perimeter dimension of the main member 84 is $36\frac{1}{4}$ X $57\frac{3}{8}$. The highest point of top contoured surface 88, which is at the barrier line 98, or top of the ramp 94, is at least 1 inch high, and in a preferred embodiment is $1\frac{1}{8}$ inch high. The lowest points of the top contoured surface 88 are at the drain 92 and the bottom of the ramp 94. The top contoured surface at the drain 22 is $\frac{3}{8}$ inches from the bottom surface 86. As can be seen in FIGS. 1 and 3, the barrier line 98 extends completely across the main member 84.

In addition to the main member 84, the shower base 24 comprises a vertically extending fiber glass lip 100 about 3 edges of the main member 84, leaving the ramp edge without such a lip. The fiber glass lip 100 is applied to the main member 84 after the main member 84 is cast and has hardened by applying resin to a fiber glass material and to the bottom and edges of the main member 84. The fiber glass material, with the resin, is then applied to the bottom surface 86 at the edges of the main member 84 and bent upwardly along the edges as is shown in FIGS. 2 and 3 and allowed to cure in this L-shape. The resin adheres this fiber glass to the main member 84 in such a manner that a waterproof seal between the fiber glass lip 100 and the main member 84 is achieved at all edges of the main member 84 except the ramp edge 96. Similarly, the resin provides a water seal at corners 102 and 104 of the fiber glass lip 100.

The shower wall panels 26, 28 and 30 are also constructed of cast cultured marble.

The vanity top is cast of cultured marble to have a banjo shape, with a back edge 106 and a right side edge 108 being perpendicular to one another. A sink bowl 101 is formed closer to the front for easy access for handicapped persons in which the sink 34 is positioned and other holes are included for a faucet and knobs. Faucets are located closer to the front for easy access for handicapped persons.

The commode 36 is a pre-manufactured item that includes wheelchair transfer grab bars 112.

Looking next at a preferred method of installing the handicap-assembly bath facility 10, first a room is chosen in which the first wall 14 is longer than the modular wall 22 and the height from the floor 21 to the ceiling 20 is less than the height of the modular wall 22. In this respect, this room need not be a bathroom, but rather can be a bedroom, study, or other room in which it is desirable to permanently, or temporarily, house a handicapped person who uses a wheelchair. The shower base 24 is then placed so that a long side edge 114 thereof is against the first wall 14 and a back edge 116 thereof is against the second wall 16 of the existing room. In this respect, the first wall 14 of the existing room must be sufficiently long that a handicapped person in a wheelchair has sufficient clearance from the third wall 18 that he can wheel his chair over the shower-base ramp 94 when the shower base 24 is in this position. The flat bottom surface 86 of the shower base 24 is placed on top of the existing floor 21 of the existing room 12 and, in this regard, can be placed on top of carpeting, flooring, or any other surface.

The next step of the method of installing the handicap-accessible bath facility 10 of this invention is to install the modular wall 22. To do this, the bottom wall assembly 44, with its factory-attached sheet rock 50, is brought into the existing room 12 through the doors thereof. In this regard, the sizes of both the bottom wall assembly 44 and the top wall assembly 42 are sufficiently small that they can be easily brought into any existing room. The bottom wall assembly 44 with the top wall assembly 42 mounted thereon is placed with a bottom surface of its base 56 resting on the existing room floor 21, the first vertical stud 68 abutting against the second wall 16 of the existing room. A shower side surface 118 of the sheet rock 50 butts against an edge 120 of the shower base 24. The bottom wall assembly 44 is nailed to the existing second wall 16 and the existing floor 21 to hold it in place. The top horizontal member 75 (FIG. 5) of the vanity support shelf 76 is placed on top of the cap 54 of the bottom wall assembly 44 with one end thereof being at, or almost at, the existing second wall 16 and it is fastened to the cap 54 with bolts, rivets, or the like to hold it in place. In this respect, the vertical member 77 of the vanity support shelf 76 is positioned to be spaced from the cap 54 so as to allow a bottom member 122 of the vinyl covering 82 to be positioned on the non-shower side of the frame 46, as can best be seen FIG. 2.

The base 56 of the top wall assembly 42 is then placed on top of the cap 54 of the bottom wall assembly 44, with the top end 74 of the second end vertical stud 70 telescoping into the second end vertical stud 72 of the top wall assembly 42 and a first end vertical stud 66 abutting against the existing second wall 16. The base 56 of the top wall assembly 42 is then securely attached to the cap 54 of the bottom wall assembly 44 and at the same time, the vanity support shelf 76 is further attached to these members by fasteners which pass through the base 56, the top horizontal member 75, and the cap 54. The first end vertical stud 66 is fastened to the existing second wall 16. In some cases, depending on the height of the existing room ceiling 20 it might be necessary to assembly the top and bottom wall assemblies 42 and 44 before they are moved into position.

With the top and bottom wall assemblies 42 and 44 in position, a shower compartment 124 is formed between the shower base 24, the first and second existing walls 14 and 16, and the sheet rock 48 and 50 of the top and bottom wall assemblies 42 and 44. The walls of this compartment are next covered with the shower wall panels 26, 28, and 30, with bottom edges 126, 128 and 130 thereof being on the inside of the fiber glass lip 100, resting on the top surface 88 of the main member 84. In this manner, all water falling downwardly from the wall panels 26, 28 and 30 onto the surface 88 of the main member 84, cannot pass between the wall panels and the main member beyond the edges of the main member 84. The shower wall panels 26, 28 and 30 are glued in position on their respective walls and they are sealed with an appropriate sealant at their intersections with one another and with the shower base 24. The side shower wall panels 26 and 30, in one embodiment, are each actually constructed of two sheets intersecting about at the barrier line 98.

Thereafter, appropriate holes are cut in the shower wall panel 30 and sheet rock 48 and 50 to install a hand held shower 132 and shower control knobs 134.

At this point, pipe and electrical connections are made in the hollow spaces 58 of the top and bottom wall assemblies 42 and 44 for connecting the shower to a house water supply system coming from the existing floor 21 or the existing second wall 16 as well as roughing in plumbing for the commode 36 and the sink 34. Also, electrical supply wires are extended from either the existing floor 21 or the existing second wall 16 to couple with wires in the light box 60.

The bottom member 122 of the final covering 82 is then slid between the steel frame 46 of the bottom wall assembly 44 and the vertical member 77 of the vanity support shelf 76 and attached to the steel frame 46 by an adhesive. Of course, before this is done, appropriate holes are cut in the bottom vinyl member 122 for accommodating pipes to the sink 34 and the commode 36. Next, a top vinyl member 136 is mounted on the non-shower side of the top wall assembly 42 above the top horizontal member 75 of the vanity support shelf 76. The back edge 106 of the vanity top 32 is placed on, and attached to, the bottom horizontal member 78 of the vanity support shelf 76 and the right side edge 108 is abutted against, and attached to, the existing second wall 16 by means of a 2 inch X 2 inch X 18 inch support 137 (FIG. 1) which is attached to the existing second wall 16. In this position the vanity top 32 serves as a brace between the existing second wall 16 and the modular wall 22, which is needed by the modular wall 22 since it is not attached at its top edge 138. It should be remembered, that the modular wall 22 is shorter in height than the existing walls 14, 16, and 18.

The mirrored wall cabinet 38 is then mounted on the non-shower side of the modular wall 22 and its light 40 is electrically connect to wires in the light box 60. Similarly, the commode 36 is installed to the left of the vanity top 32 against the modular wall 22 so as to receive its water supply therefrom. A commode sewage drain, not shown, is placed in the floor 21 and a drain vent can be extended diagonally in the modular wall 22 to an existing vent in the second existing wall 16 or can be extended vertically upwardly out the top of the modular wall 22 through the existing ceiling 20. In the later case an aesthetically pleasing outer cover is used for covering the vent pipe exposed above the modular wall 22.

It will be understood by those of ordinary skill in the art that the handicap-assembly bath facility of this invention can be relatively easily, and inexpensively mounted in an existing room. Because the modular wall 22 is shorter than existing walls in the room, existing room lighting provides light into the shower compartment 124. Similarly, because the shower base 24 is simply placed on, and supported by, the existing floor 21, the handicap-accessible bath facility 10 can be relatively easily and inexpensively removed from the existing room without requiring a great deal of work to place the room back in its original condition. Further, it is possible to reuse most of the elements of the handicap-accessible bath facility in another house once it has been dismantled.

Also, it will be appreciated that the shower-base ramp 94 on the one piece main member 84 of the shower base 24 allows one in a wheelchair to easily enter and leave the shower compartment 124 while the barrier line 98 positioned between the ramp 94 and the drain depression 90 prevents water striking most of the main member 84 from passing through an entrance opening 140. The shower base 24 has the functions of: catching water from the hand held shower 132 and channeling it to the drain hole 92; forming a waterproof seal with the shower wall panels 26, 28 and 30 to prevent water from passing between intersections thereof; acting as an inclined plane for accepting a wheelchair; and giving a clean and cleanable environment for the shower compartment 124.

It will also be understood that the vanity top 32 not only serves to support the sink 34 and provide a nice work surface, but also provides a strong support for the modular wall 22. It should be noted that the vanity top 32 has nothing other than plumbing below it so that a person in a wheelchair can easily wheel him or herself thereunder for reaching the sink 34 and the mirrored wall cabinet 38.

While the invention has been particularly shown and described with reference to a preferred embodiment, it will be understood by those skilled in the art that various changes in form and detail may be made therein without departing from the spirit and scope of the invention. For example, it is possible to place a metallic edge at the ramp edge 96 in order to protect the ramp edge 96 from breaking. Also, the top and bottom wall assemblies 42 and 44 need not be made of steel frames 46, but rather can be made of wooden frames as well as frames of other materials. Similarly, the vanity support shelf 76 need not be constructed of metal, but rather, could be constructed of other materials. In a like manner, the shower base 24 could be constructed of other materials than those set forth herein as could the shower wall panels 26, 28 and 30. It would be possible to utilize modular walls instead of the existing walls 14 and 16 to completely form the shower compartment 124. Also, the first and second existing room walls could be walls of a house in construction.

The embodiments of the invention in which an exclusive property or privilege are claimed are defined as follows:

1. A method of constructing a handicap-accessible bath facility in an existing room having room walls, a ceiling, and a floor said method comprising the steps of:

placing a prefabricated rectangular, relatively flat, shower base in a corner of said existing room with a long edge of said shower base contacting a first existing wall of said existing room and a back edge of said shower base contacting a second existing wall of said existing room which is perpendicular to said first existing wall, said shower base being molded of a single piece of non-porous material to form a flat bottom surface for resting on said room floor, said shower base having a drain hole therein for allowing drain water from said shower to pass therethrough, a top surface of said shower base being molded to form a depression surrounding said drain hole for channeling water contacting said top surface at said depression into said drain hole, said top surface of said shower base being further molded to form a ramp at a ramp edge thereof which is opposite to said back edge, said ramp edge facing, but being spaced a substantial distance from, a third existing wall of said existing room which is perpendicular to said first existing room wall, said ramp leading upwardly from the bottom surface of said shower base at said ramp edge to a water-retaining barrier line on the top surface at a height of at least 1 inch above said bottom surface across the entire width of said shower base, said water retaining barrier line being positioned between said ramp edge and said depression and being space from said ramp edge not less than 3 inches, said depression beginning approximately at said barrier line, said ramp edge having a length at least as great as the width of a wheelchair but the length of said shower base (the distance from said ramp edge to said back edge), and the length of said depression (approximately the distance from said barrier line to said back edge) being substantially greater than the length of said ramp edge;

placing a prefabricated modular wall against a second elongated side edge of said shower base, on an opposite side edge from said first existing room well, on said floor, with a first end edge of the modular wall abutting against said second existing room wall, said modular wall having a length which is approximately the same as said shower base and a height which is substantially less than a height of said existing room extending from said floor to said ceiling and fastening said modular wall to said floor and said second existing room wall;

mounting waterproof wall panels on said first existing room wall, said second existing room wall, and said modular wall so that bottom ends of said wall panels are sealingly attached to said shower base, whereby water flowing down said wall panels falls on said top surface of said shower base and cannot flow over said first, second and back edge of said shower base;

mounting a shower head and shower control knobs on said modular wall above said shower base for spraying water on said shower base depression;

placing utility lines in said modular wall; and connecting said shower head and faucet to said utility lines in said modular wall.

2. A method as in claim 1 wherein, said step of placing said planar modular wall involves attaching together separate prefabricated factory-made top and bottom wall assemblies, each comprising stud frames and sheet rock on shower sides thereof, said top and bottom wall assemblies, when attached together, forming approximately the full height and length of said modular wall, and wherein said step of positioning said modular wall further includes the substeps of first positioning said bottom wall assembly and then positioning said top wall assembly thereon.

3. A method as in claim 1 wherein, said step of placing said shower base includes the substep of using a factory-constructed shower base whose ramp reaches a top surface of at least $1\frac{1}{8}$ inch at said water-retaining barrier line and which has a length of 4 inches.

4. A method as in claim 1 wherein, said step of placing said shower base further includes the substep of first attaching separate, non-porous vertically extending lips to three outer edges of said non-porous main member and wherein said step of mounting waterproof wall panels includes the substep of placing bottom ends of said wall panels on inside surfaces of said lips to improve said sealing attachment of said wall panels to said non-porous main member.

5. A method as in claim 4 wherein, said step of placing said shower base further includes the substep of using a main member constructed of a synthetic rock-like material and a lip constructed of fiber glass including a resin.

6. A handicap-accessible bath facility formed in a conventional room having room walls, a ceiling and a floor, said handicap-accessible bath facility comprising:

a planar modular wall having a length which is less than a length of a first room wall for extending between second and third room walls which are perpendicular to, and at the ends of, said first room wall and having a height which is less than a height of said existing room extending from said floor to said ceiling, said modular wall being hollow for receiving therein utility liens for servicing a sink, and a shower mounted adjacent to said modular wall, said modular wall being mountable in said existing room with a bottom edge resting on said floor and a first end edge abutting said second room wall so that said modular wall extends perpendicular to said second room wall with a second edge being spaced from said third room wall opposite to said second wall;

a rectangular, relatively flat, shower base molded of a single piece of non-porous material to form a flat bottom surface for resting on said room floor, said shower base having a drain hole therein for allowing drain water from said shower to pass therethrough, a top surface of said shower base being molded to form a depression surrounding said drain hole for channeling water contacting said top surface at said depression into said drain hole, said top surface of said shower base being molded to form a ramp at a ramp edge thereof, said ramp leading upwardly from the bottom surface of said shower base at said ramp edge to a water-retaining barrier line on the top surface at a height of at least 1 inch above said surface across said shower base, said water retaining barrier line being positioned between said ramp edge and said depression and being spaced from said ramp edge not less than 3 inches, said depression beginning approximately at said barrier line, said shower base being of a size for fitting snugly between said modular wall and said first room wall when lying with said flat bottom surface thereof on said existing room floor with a second shower-base edge thereof abutting against said second room wall and said ramp edge being located near said second end edge of said modular wall, said ramp edge having a length at least as great as the width of a wheelchair but the length of said shower base (the distance from said ramp edge to said 2*d* shower base edge, which is approximately the same as the length of the modular wall), and the length of said depression (approximately the distance from said barrier line to said 2*d* base edge) being substantially greater than the length of said ramp edge;

wall panels mountable on surfaces of said first and second room walls and a shower side of said modular wall within a shower compartment defined by these surfaces;

engagement means for engaging said wall linings to said shower base such that water in said shower compartment at said engagement cannot escape from said shower compartment between said wall linings and said shower base;

whereby said handicap-accessible bath facility can be mounted in an existing room and a handicapped person in a wheel chair can enter said shower compartment by rolling up said shower-base ramp to be positioned over said shower base depression which channels water from said shower head into said drain hole, said water retaining barrier line preventing water from leaving said shower compartment at said ramp edge of said shower base.

7. A handicap-accessible bath facility as in claim 6 wherein, said engagement means comprises at each edge of the shower base, except said ramp edge, a non-porous lip extending upwardly above said shower base top surface, said lip being formed of a separate piece from the rest of said shower base but being sealingly attached to the rest of said shower base, and wherein said wall panels are positioned on inside surfaces of said lip so that water rolling down said wall panels falls on said top surface.

8. A handicap-accessible bath facility as in claim 6 wherein the length of said shower base is at least $57\frac{3}{8}$ inches and wherein the width thereof is substantially less than $57\frac{3}{8}$.

9. A handicap-accessible both facility as in claim 6 wherein said water retaining barrier line is spaced from said ramp edge a distance of between 3 and 4 inches.

10. A method of constructing a handicap-accessible bath facility in an existing room having room walls, a ceiling, and a floor said method comprising the steps of:

placing a rectangular, relatively flat, shower base in a corner of said existing room with a long edge of said shower base contacting a first existing wall of said existing room and a back edge of said shower base contacting a second existing wall of said existing room which is perpendicular to said first existing wall, said shower base being molded of a single piece of non-porous material to form a flat bottom surface for resting on said room floor, said shower base having a drain hole therein for allowing drain water from said shower to pass therethrough, a top surface of said shower base being molded to form a depression surrounding said drain hole for channeling water contacting said top surface at said depression into said drain hole, said top surface of said shower base being further molded to form a ramp at a ramp edge thereof which is opposite to said back edge, said ramp edge facing, but being spaced a substantial distance from, a third existing wall of said existing room which is perpendicular to said first existing room wall, said ramp leading upwardly from the bottom surface of said shower base at said ramp edge to a water-retaining barrier line on the top surface at a height of at least 1 inch above said bottom surface across the entire width of said shower base, said water retaining barrier line being positioned between said ramp edge and said depression and being space from said ramp edge not less than 3 inches, said depression beginning approximately at said barrier line;

placing a modular wall against a second elongated side edge of said shower base, on an opposite side edge from said first existing room wall, on said floor, with a first end edge of the modular wall abutting against said second existing room wall, said modular wall having a length which is approximately the same as said shower base and a height which is substantially less than a height of said existing room extending from said floor to said ceiling and fastening said modular wall to said floor and said second existing room wall;

mounting waterproof wall panels on said first existing room wall, said second existing room wall, and said modular wall so that bottom ends of said wall panels are sealingly attached to said shower base, whereby water flowing down said wall panels falls on said top surface of said shower base and cannot flow over said first, second, and back edges of said shower base;

mounting a shower head and shower control knobs on said modular wall above said shower base;

placing utility lines in said modular wall;

mounting a planar vanity top on a non-shower side of said modular wall, edges of said vanity top forming a 90° angle, with one of said edges being mounted on said modular wall and the other edge being mounted on said second existing wall to thereby support said modular wall to provide extra support between said modular wall and said second existing room wall, said vanity top including a sink and faucet with control knobs;

connecting said shower head and faucet to said utility lines in said modular wall.

11. A method as in claim 10 wherein, said step of placing said planar modular wall involves attaching together separate factory-made top and bottom wall assemblies, each comprising stud frames and sheet rock on shower sides thereof, said top and bottom wall assemblies, when attached together, forming approximately the full height and length of said modular wall, and wherein said step of positioning said modular wall further includes the substeps of first positioning said bottom wall assembly and then positioning said top wall assembly thereon.

12. A method as in claim 10 wherein, said step of placing said shower base includes the substep of using a factory-constructed shower base whose ramp reaches a top surface of at least 1⅛ inch and which has a length of 4 inches.

13. A method as in claim 10 wherein, said step of placing said shower base further includes the substep of first attaching non-porous vertically extending lip to three outer edges of said non-porous main member and wherein said step of mounting waterproof wall panels includes the substep of placing bottom ends of said wall panels on inside surfaces of said lips to improve said sealing attachment of said wall panels to said non-porous main member.

14. A method as in claim 13 wherein, said step of placing said shower base further includes the substep of using a main member constructed of a synthetic rock-like material and a lip constructed of fiber glass including a resin.

* * * * *